US005228460A

United States Patent [19]

Sprinkel et al.

[11] Patent Number: 5,228,460

[45] Date of Patent: Jul. 20, 1993

[54] LOW MASS RADIAL ARRAY HEATER FOR ELECTRICAL SMOKING ARTICLE

[75] Inventors: F. Murphy Sprinkel, Glen Allen; Everett C. Grollimund, Midlothian, both of Va.

[73] Assignee: Philip Morris Incorporated, New York, N.Y.

[21] Appl. No.: 805,617

[22] Filed: Dec. 12, 1991

[51] Int. Cl.[5] ..... A24D 1/18

[52] U.S. Cl. ..... 131/194; 131/359; 131/273; 338/51; 338/223; 128/202.21; 128/203.27

[58] Field of Search ..... 131/194, 273, 359, 369; 338/24, 51, 59, 223-225; 219/552, 553; 128/202.21, 203.26, 203.27, 204.17

[56] References Cited

U.S. PATENT DOCUMENTS

| | | | |
|---|---|---|---|
| 573,558 | 12/1896 | Voss | 338/51 X |
| 2,358,406 | 9/1944 | Lightgarn | 338/51 X |
| 2,739,213 | 3/1956 | Beckjord | 338/51 X |
| 2,861,163 | 11/1958 | Asakawa | 338/224 X |
| 2,905,919 | 9/1959 | Lorch et al. | 338/224 |
| 2,974,669 | 3/1961 | Ellis | 131/172 |
| 3,114,825 | 12/1963 | Kilburn et al. | 338/51 X |
| 3,541,489 | 11/1970 | Person | 338/51 |
| 4,036,224 | 7/1977 | Choporis et al. | 128/212 |
| 4,250,397 | 2/1981 | Gray et al. | 338/223 X |
| 4,732,168 | 3/1988 | Resce et al. | 131/359 |
| 5,060,671 | 10/1991 | Counts et al. | 131/273 X |

FOREIGN PATENT DOCUMENTS

| | | | |
|---|---|---|---|
| 2453685 | 5/1976 | Fed. Rep. of Germany | 338/51 |
| 601603 | 3/1926 | France | 338/24 |
| 0249202 | 10/1990 | Japan | 338/223 |
| 0970485 | 11/1982 | U.S.S.R. | 338/225 |
| 0970486 | 11/1982 | U.S.S.R. . | |

*Primary Examiner*—V. Millin
*Assistant Examiner*—J. Doyle
*Attorney, Agent, or Firm*—Jeffrey H. Ingerman

[57] ABSTRACT

A heating element to provide heat to a tobacco flavor medium, for use in an electrical smoking article, by converting electrical energy to heat through the use of a material with electrically resistive properties is provided. The material is arranged in a radial array of blades with a current density profile such that a maximum area of each blade provides heat to the tobacco flavor medium dispersed thereon. The blade is generally U-shaped to assure dispersion of heat evenly to avoid hot spots along the blade and is tapered to reduce mass toward the mouth end of the heating element so as to maximize the heated area.

19 Claims, 3 Drawing Sheets

FIG. 1
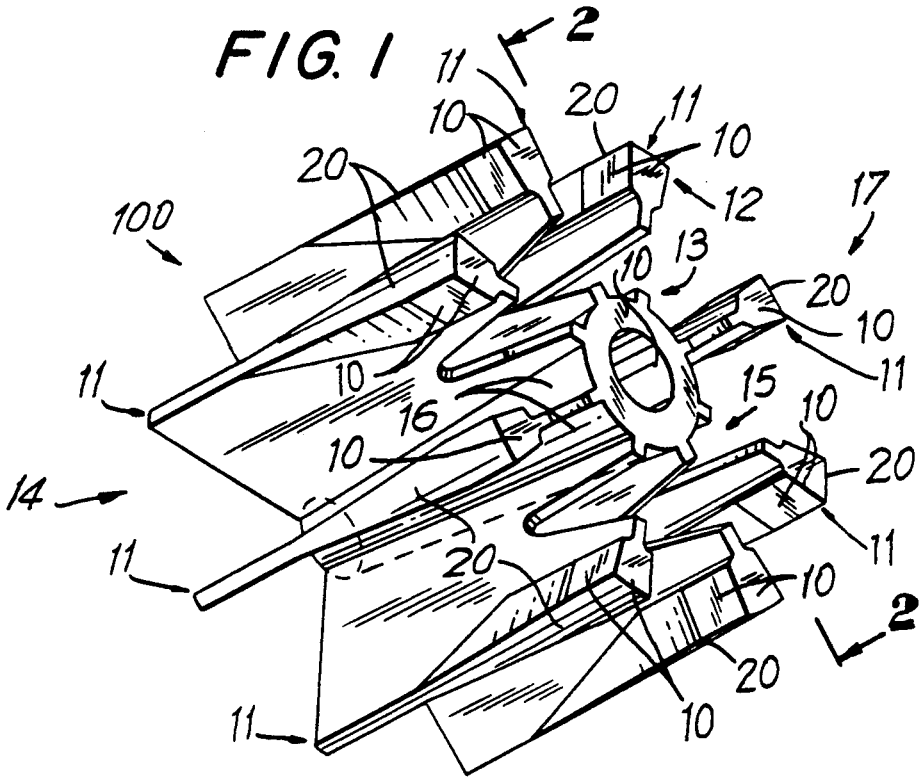
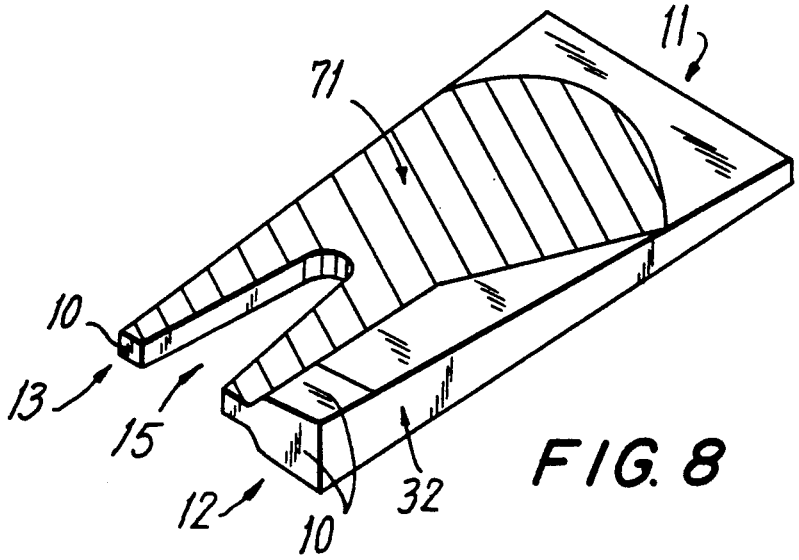
FIG. 8

FIG. 2
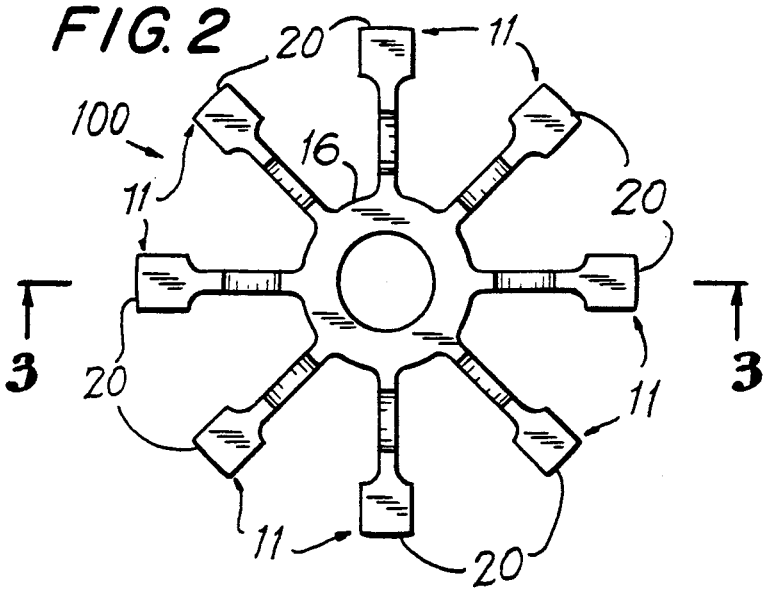
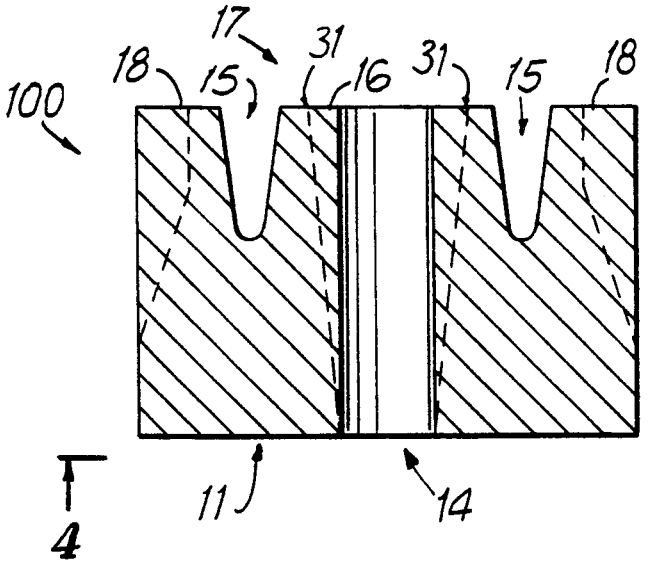
FIG. 3
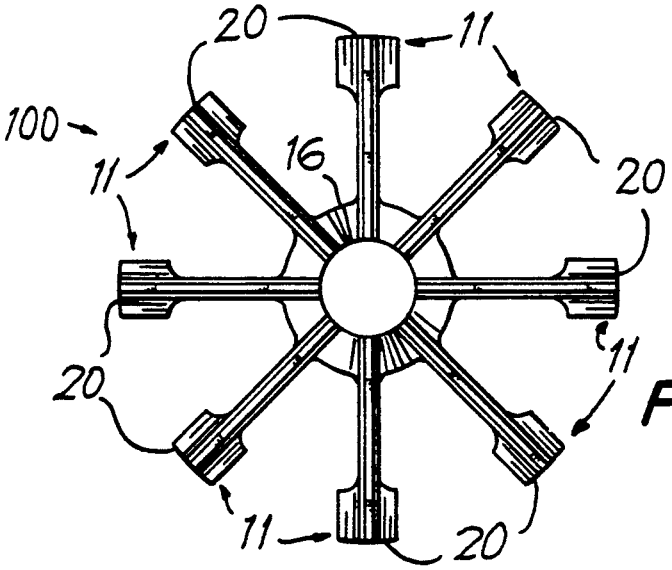
FIG. 4

LOW MASS RADIAL ARRAY HEATER FOR ELECTRICAL SMOKING ARTICLE

BACKGROUND OF THE INVENTION

This invention relates to electric heating elements used to heat a tobacco flavor medium in an electrical smoking article. In particular this invention relates to such a heating element arranged in a radial array.

One type of electrical smoking article is disclosed in copending, commonly-assigned U.S. patent application Ser. No. 07/444,746, filed Dec. 1, 1989 and now U.S. Pat. No. 5,060,671, which is hereby incorporated by reference in its entirety. In such an electrical smoking article, a flavor bed of a tobacco flavor medium, such as tobacco or tobacco-derived substances, is heated electrically to release a tobacco flavor substance without burning. As the tobacco flavor medium is heated, a smoker at the mouth or downstream end of the device draws air in and around the heating element by inhaling, and thereby receives the tobacco flavor substance.

The above-identified application discloses as a possible heater configuration a non-reactive radial array of blades upon which the tobacco flavor medium is dispersed, providing a number of flavor puffs equal to the number of blades. In one embodiment the blades in the radial array are generally U-shaped but with rectangular inner and outer corners. Current flows through such rectangular U-shaped or slotted blades between the two connector points around the slotted area. Current density in such a blade is non-uniform, peaking at the sharp inner corners at the end of the slot. High current density leads to areas of extreme heating around the inner corners, with temperatures in excess of the desired operating temperature.

It would be desirable to provide a heating element with a current density profile which would maximize the distribution of heat so as to provide heat to the greatest amount of tobacco flavor medium.

It would also be desirable to provide a heating element which is a radial array of generally U-shaped blades which would have only rounded corners to eliminate areas of heating, or "hot spots", which exceed the desired operating temperature.

It would also be desirable to provide a heating element with optimized three-dimensional variations in the geometric configuration of the element in order to reduce the area in which heating exceeds the desired operating temperature by improving current distribution across the heating element.

It would also be desirable to provide a heating element comprised of a material which optimally minimizes mass so as to lower energy consumption while providing the necessary strength characteristics for use in the desired dimensions.

Furthermore, it would be desirable to provide a heater which would have dimensions enabling it to fit inside an electrical smoking article which is approximately the size and shape of a conventional cigarette.

It would further be desirable to provide a heater made from a material which evolves no undesirable components when heated.

Finally, it would be desirable to produce a heater with one piece construction which could be produced by machining or molding processes, or by extruding and machining processes, which are sufficiently cost-effective to allow the heater to be a replaceable and disposable component.

SUMMARY OF THE INVENTION

It is an object of this invention to provide a heating element for an electrical smoking article which provides heat to a maximum area of flavor generating medium by having a current density profile which would maximize the area of heat distribution.

It is also an object of this invention to provide a heating element which is a radial array of U-shaped blades which have only rounded corners so as to eliminate hot-spots.

It is also an object of this invention to provide a heating element with optimized three-dimensional variations in the geometric configuration of the element in order to reduce the area of heating which exceeds the desired operating temperature by improving current distribution across the heating element.

It is also an object of this invention to provide a heating element comprised of a material which optimally minimizes mass so as to lower energy consumption while providing the necessary strength characteristics for use in the desired dimensions.

Furthermore, it is an object of this invention to provide a heating element which would have dimensions enabling it to fit inside an electrical smoking article which is approximately the same size as a conventional cigarette.

A further object of the invention is to provide a heating element which is composed of a material which evolves no undesirable components when heated.

Finally, it is an object of this invention to provide a heating element which can be machined or molded, or extruded and machined, sufficiently cost-effectively as to allow the heater to be a replaceable and disposable component.

In accordance with this invention, there is provided a heating element for an electrical smoking article. The heating element has a mouth end, a rod end and a hub. A plurality of electrically conductive blades are attached to the hub and extend radially therefrom. A tobacco flavor medium can be dispersed on the blades. Each blade has a geometry which optimizes the uniformity of electrical current distributed through the blade, thereby maximizing the area on each blade which is substantially uniformally heated to the operating temperature while minimizing areas of heating which exceed the operating temperature. Contact means on the heater conduct electrical energy from an electrical energy source to the plurality of blades.

BRIEF DESCRIPTION OF THE DRAWINGS

The above and other objects and advantages of the invention will become apparent upon consideration of the following detailed description, taken in conjunction with the accompanying drawings, in which like reference characters refer to like parts throughout, and in which:

FIG. 1 is a rod-end perspective view of a first embodiment of a heating element according to the present invention;

FIG. 2 is a rod-end elevational view of the heating element of FIG. 1, taken from line 2—2 of FIG. 1;

FIG. 3 is a longitudinal cross-sectional view of the heating element of FIGS. 1 and 2, taken from line 3—3 of FIG. 2;

FIG. 4 is a mouth-end elevational view of the heating element of FIGS. 1-3, taken from line 4—4 of FIG. 3;

FIG. 8 is a rod-end perspective view of one blade of a first preferred embodiment with the area of substantially uniform heating depicted thereon.

DETAILED DESCRIPTION OF THE INVENTION

Figure 5:
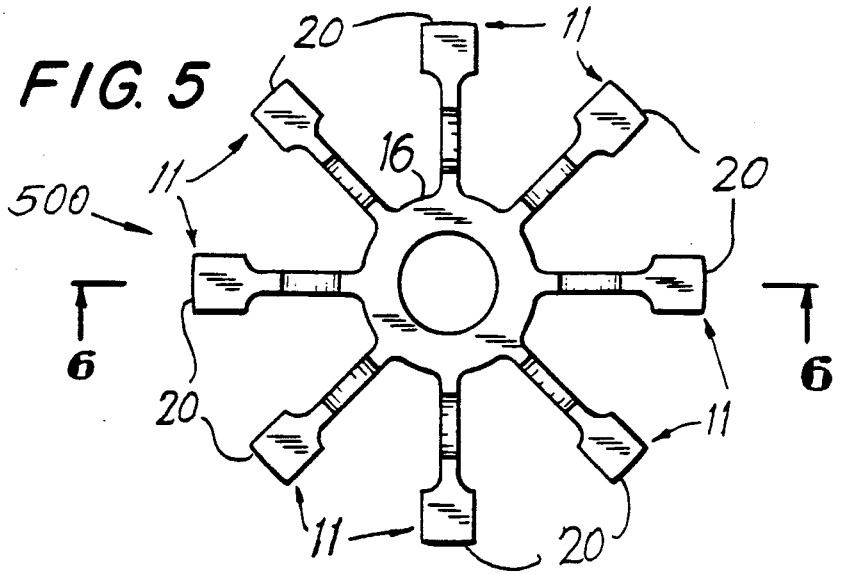
FIG. 5 is a rod-end elevational view of a second embodiment of a heating element according to the present invention.

The heating element of this invention is a radial array of generally U-shaped blades connected to a central hub. The heating element is connected to an electrical energy source at two contact points. The first contact is fixed at the central hub, while the second contact point is varied depending on which blade is to be heated to release flavor. Contact points may be placed anywhere on the surface of the heating element resulting in the heating of a different area by the electrical energy. The number of flavored puffs available per heating element is preferably equivalent to the number of blades in each heating element.

The geometry of the heating element is important in determining the amount of energy necessary to reach the desired operating temperature over a large enough area to provide the smoke user with the desired amount of flavor. Each blade is rectangular and generally U-shaped, with rounded interior corners to eliminate the "hot-spots" found in strictly rectangularly bladed configurations.

The blade geometry is preferably chosen to achieve the desired heating. Each blade preferably decreases in thickness circumferentially as one proceeds axially from the rod end to the mouth end. Each blade also preferably becomes radially wider as one proceeds axially, so that the thinner part of the blade at the mouth end has a greater area than the thicker part of the blade at the rod end. This preferred geometry lowers the mass of each blade while maximizing the heating area on each side of each blade. A lower blade mass results in a lower energy requirement to heat the blade to the desired operating temperature in that area of the blade. The axial variation in the radial blade dimension also contributes to diverting the current flow over the maximum possible area, as described in more detail below. Thus, the blade geometry affects the distribution of energy throughout the blade, maximizing the area which reaches but does not substantially exceed the desired operating temperature.

The geometry of the most preferred embodiment of the invention permits an operating temperature of at least about 500° C. over an area of approximately 18 $mm^2$ (9 $mm^2$ on each side of each blade) using at most about 3 calories of input energy. The total resistance a seen by the electrical energy source is between about 1.2 Ω and about 1.3 Ω. This is effectively the resistance per blade, since electricity is conducted by only one blade at any one time.

The heating element is preferably made of a disposable material which has a minimal environmental impact upon disposal. A particularly preferred material is a graphite and carbon composite material made by mixing carbon, graphite, fillers and binders and heating the mixture until cured. This material has been found to have the proper resistive characteristics and evolves no undesirable constituents when heated to the operating temperature. Another preferred material is carbon Grade 1294 manufactured by Stackpole Carbon Division of Stackpole Corporation. Carbon Grade 1294 has a resistivity of approximately 0.0025 Ω-inch and a flexural strength of 12000 psi. Other preferred materials are Grades 2161, 2207, 1219 and 2020 produced by Stackpole Corporation.

Although it is possible to simply apply current directly to the graphite and carbon composite between any two points on the heating element, it is preferable to lower contact resistance by plating the contacts with a metal. Non-reactive metals such as gold, platinum, tantalum or stainless steel may be used as contact materials. Lowering the contact resistance decreases the amount of energy dissipated at the contact point. Thus, more energy will be available to be converted into heat by the blades, permitting more efficient use of the electrical energy source.

Construction of the heating element can be accomplished through machining, molding or extruding. Although a one-piece construction is preferred, the element could be constructed of individually machined component parts if desired. Whichever construction method is used the overall outer dimension should preferably be kept under 8 mm in diameter to facilitate use of the heating element in an electrical smoking article of approximately the size of a conventional cigarette. Each blade preferably has a rib or other thickening at the radial outermost edge in order to strengthen the heating element. This rib also provides a larger current pathway at the variable contact point which tends to lessen contact heating by decreasing contact resistance. The rib distributes the current to the blade by increasing the current density along the edge which causes more of the current to take a longer pathway away from the slot.

A central hub to which all blades are attached is preferably provided for strength and to act as a guide for each insertion by a smoker of the element into a socket of the electrical smoking article. The hub may be solid, or more preferably, hollow, as long as the heating element is sufficiently strong to withstand insertion into the electrical smoking article without breaking.

A first preferred embodiment of the invention is shown in FIGS. 1-4. The heater array 100 of FIG. 1 contains an array of eight blades 11 with each blade having dispersed thereon a tobacco flavor medium. The surfaces 10 at the rod end of heating element of FIG. 1 are plated with an electrically conductive material such as gold, platinum, tantalum or stainless steel. When an electrical energy source is connected between contacts 12, 13, electrical current flows into and through that heating element blade 11. Although the contact points 12, 13 are located at a common end of the heating element in the preferred embodiment, contact points could be dispersed anywhere along the exterior of the heating element. The heat created by the flow of electrical energy through the resistive blade material causes the tobacco flavor generating medium dispersed each side of each blade 11 to release a tobacco flavor substance which can be drawn in by the user.

Each blade 11 is approximately U-shaped with rounded interior corners. Each blade 11 has a rib 20 at its radially outermost edge. Each blade 11 decreases in circumferential thickness as one proceeds axially from rod end 17 to mouth end 14, so that blade 11 is substantially thinner at mouth end 14 than at rod end 17. Rib 20 preferably tapers at a faster rate than the remainder of blade 11, its thickness decreasing to that of the remainder of blade 11 before mouth end 14. Each blade 11 is radially wider at mouth end 14 than at rod end 17 as the diameter of hollow central hub 16 correspondingly decreases from rod end 17 to mouth end 14, which helps control the current density as described in more detail below. The taper 31 of hub 16 is linear, such that blade 11 becomes wider radially in a linear manner.

Figure 6:
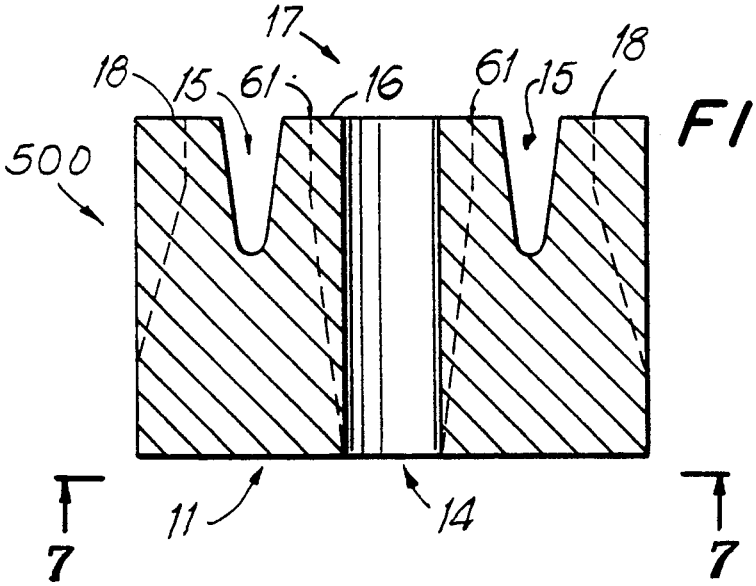
FIG. 6 is a longitudinal cross-sectional view of the heating element of FIG. 5, taken from line 6—6 of FIG. 5.
Figure 7:
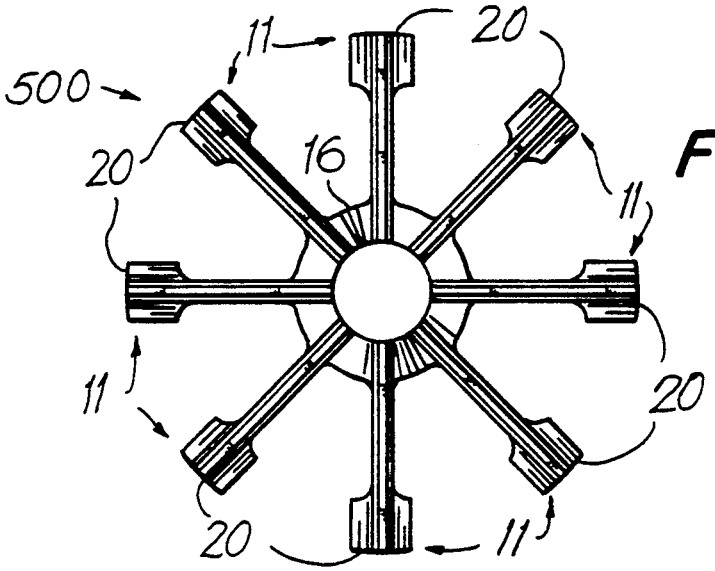
FIG. 7 is a mouth-end elevational view of the heating element of FIGS. 5 and 6, taken from a line 7—7 of FIG. 6.

A second preferred embodiment of heater array 500 according to the invention is shown in FIGS. 5-7. Taper 61 of center hub 16 on this embodiment is nonlinear. The center hub 16 is cylindrical for approximately one quarter of the axial length of the heating element. Center hub 16 then tapers linearly from that point to the mouth end 14. Heater array 500 is otherwise identical to heater array 100.

In either embodiment, center hub 16 need not taper to a point at mouth end 14. The exact taper is dictated by the composition of materials used, the process of manufacture and the desired heating area. The shaded area 71 on blade 11, shown in FIG. 8 depicts the current density profile through blade 11. This is approximately the area of substantially uniform heating at about the desired operating temperature. The taper of hub 16 and rib 20 causes the current density profile to provide a greater area 71 of substantially uniform heating than if hub 16 were not tapered, by causing the current flow to diverge further toward end 14 before returning to end 17.

Thus, it is seen that a low mass radial array heater, which can be machined, molded or extruded from a non-reactive substance to provide heat substantially uniformly to the maximum possible area of a tobacco flavor medium dispersed on each side of each blade, by having a controlled current density profile, is provided. One skilled in the art will appreciate that the present invention can be practiced through embodiments other than the ones described, which are presented for the purpose of illustration and not limitation, and the present invention is limited only by the claims which follow.

What is claimed is:

1. A heating element for an electrical smoking article, said heating element having a mouth end and a rod end and comprising:

a hub;

a plurality of electrically conductive blades attached to said hub and extending radially therefrom, upon which a tobacco flavor medium can be dispersed, each blade having a generally U-shaped geometry with rounded interior corners for optimizing the uniformity of electrical current distributed through said blade and maximizing the area on each blade which is substantially uniformly heated to the operating temperature and minimizing areas of heating which exceed the operating temperature; and contact means for conducting electrical energy from an electrical energy source to the said plurality of blades.

2. The heating element of claim 1 wherein each blade of said radial array decreases in circumferential thickness as one proceeds axially from said rod end to said mouth end.

3. The heating element of claim 1 wherein each blade of said radial array increases radially in width as one proceeds axially from said rod end to said mouth end.

4. The heating element of claim 1 wherein said hub has:

a hollow core; and an external surface, said external surface having a diameter that decreases from one of said rod end and said mouth end to the other of said rod end and said mouth end.

5. The heating element of claim 4 wherein the diameter of said external surface decreases linearly from said rod end to said mouth end.

6. The heating element of claim 4 wherein the diameter of said external surface decreases nonlinearly from said rod to said mouth end.

7. The heating element of claim 4 wherein said external surface has a constant diameter portion adjacent said rod end and decreases in diameter linearly from the mouth end of said constant diameter portion to said mouth end of said heating element.

8. The heating element of claim 4 wherein said external surface has a constant diameter portion adjacent said rod end and decreases in diameter nonlinearly from the mouth end of said constant diameter portion to said mouth end of said heating element.

9. The heating element of claim 1 wherein said hub has:

a solid core; and an external surface, said external surface having a diameter that decreases from one of said rod end and said mouth end to the other of said rod end and said mouth end.

10. The heating element of claim 9 wherein the diameter of said external surface decreases linearly from said rod end to said mouth end.

11. The heating element of claim 9 wherein the diameter of said external surface decreases nonlinearly from said rod end to said mouth end.

12. The heating element of claim 9 wherein said external surface has a constant diameter portion adjacent said rod end and decreases in diameter linearly from the mouth end of said constant diameter portion to said mouth end of said heating element.

13. The heating element of claim 9 wherein said external surface has a constant diameter portion adjacent said rod end and decreases in diameter nonlinearly from the mouth end of said constant diameter portion to said mouth end of said heating element.

14. The heating element of claim 1 wherein said blades and hub comprise a graphite and carbon composite material.

15. The heating element of claim 14 wherein said heating element operates at up to about 500° C. using about 3 calories of electrical energy each time the heating element is activated.

16. The heating element of claim 15 wherein each of said blades has a resistance between about 1.2 Ω and about 1.3 Ω.

17. The heating element of claim 1 having a diameter of at most about 8 mm.

18. The heating element of claim 1 further comprising a metallic layer dispersed on said contact means.

19. The heating element of claim 18 wherein said metallic layer is selected from the group consisting of gold, platinum, tantalum and stainless steel.

* * * * *